US007581427B2

(12) United States Patent
Mayer

(10) Patent No.: US 7,581,427 B2
(45) Date of Patent: Sep. 1, 2009

(54) WORKSPACE ANALYTE SENSING SYSTEM AND METHOD USING A FAN TO MOVE SAMPLES FROM THE WORKSPACE TO THE SENSOR

(75) Inventor: Daniel W. Mayer, Wyoming, MN (US)

(73) Assignee: Mocon, Inc., Minneapolis, MN (US)

( * ) Notice: Subject to any disclaimer, the term of this patent is extended or adjusted under 35 U.S.C. 154(b) by 199 days.

(21) Appl. No.: 11/559,640

(22) Filed: Nov. 14, 2006

(65) Prior Publication Data

US 2008/0110562 A1 May 15, 2008

(51) Int. Cl.
*G01N 7/00* (2006.01)

(52) U.S. Cl. ..... 73/23.2

(58) Field of Classification Search ..... 73/23.2
See application file for complete search history.

(56) References Cited

U.S. PATENT DOCUMENTS 3,274,746 A 9/1966 James et al.
3,664,086 A 5/1972 James et al.
3,789,888 A * 2/1974 James et al. ..... 141/4
4,829,774 A * 5/1989 Wassibauer et al. ..... 62/78
5,099,679 A * 3/1992 Huerlimann et al. ..... 73/19.06
5,212,993 A * 5/1993 Mayer ..... 73/864.21
5,437,837 A * 8/1995 Olson et al. ..... 422/3
5,457,963 A * 10/1995 Cahill-O'Brien et al. ..... 62/78
5,682,723 A 11/1997 Nowotarski et al.
5,879,732 A * 3/1999 Caracciolo et al. ..... 426/231
6,032,438 A 3/2000 Sanfilippo et al.
6,179,986 B1 * 1/2001 Swette et al. ..... 205/337

FOREIGN PATENT DOCUMENTS

EP 1112936 A1 7/2001
WO WO2006/076110 A2 7/2006

* cited by examiner

*Primary Examiner*—Daniel S Larkin
(74) *Attorney, Agent, or Firm*—Sherrill Law Offices, PLLC

(57) ABSTRACT

A system and method for sensing and reporting atmospheric analyte levels in a workspace. The system includes (i) a remotely located gas analyte sensor, (ii) a tube attached to the sensor and defining a lumen through which the sensor is placed in fluid communication with a workspace, and (iii) a fan in sealed fluid communication with the lumen of the tube for continuously moving gaseous content from the workspace through the lumen and into operative engagement with the sensor. The method includes the steps of (a) placing the distal end of the tube within a workspace, (b) activating the fan so as to continuously move gaseous content from the workspace through the tube and into operative engagement with the sensor, and (c) sensing and reporting analyte levels in the workspace with the sensor.

15 Claims, 3 Drawing Sheets

WORKSPACE ANALYTE SENSING SYSTEM AND METHOD USING A FAN TO MOVE SAMPLES FROM THE WORKSPACE TO THE SENSOR

BACKGROUND

Industrial processes often require maintenance of an atmospheric analyte within a workspace above or below a given concentration range. Analytes of interest or concern are typically reactive analytes such as $O_2$, CO or VOCs. One such example is the modified atmosphere packaging (MAP) of foods where the workspace in which the foods are packaged is flushed with an inert gas, such as nitrogen, to reduce the oxygen concentration within the resultant packaging and thereby increase the shelf life of the packaged product.

Analyte concentration within a workspace is typically measured by pumping atmospheric samples from the workspace to a remotely located on-line analyte reading analyzer. While generally effective, such systems are relatively expensive, prone to frequent failures, and have a short life-span. While repair and replacement of these systems is problematic, the greater business concern is the time and cost involved in preventing potentially defective product, produced while the analyte sensing system was not functioning, from reaching consumers. Of even greater concern is that defective product will reach consumers, resulting in a tarnishing of the business' reputation.

Accordingly, a need exists for an inexpensive yet reliable atmosphere analyte sensing system possessing an extended useful life.

SUMMARY OF THE INVENTION

A first aspect of the invention is a system for sensing and reporting atmospheric analyte levels in a workspace. The system includes (i) a remotely located gas analyte sensor, (ii) a tube attached to the sensor and defining a lumen through which the sensor is placed in fluid communication with a workspace, and (iii) a fan in fluid communication with the lumen of the tube for continuously moving gaseous content from the workspace through the lumen and into operative engagement with the sensor.

A specific embodiment of the first aspect of the invention is a system for sensing and reporting $O_2$ levels in the workspace of a form, fill, and seal machine. The system includes (i) a form, fill, and seal machine defining a workspace open to the atmosphere wherein packaging is filled with a product and sealed, (ii) a flush system for flushing the workspace with an inert gas to reduce oxygen levels in the workspace, (iii) an oxygen sensor remotely located relative to the workspace, (iv) a tube attached to the oxygen sensor and defining a lumen through which the oxygen sensor is placed in fluid communication with the workspace, and (v) a fan in sealed fluid communication with the lumen of the tube for continuously moving gaseous content from the workspace into operative engagement with the oxygen sensor.

A second aspect of the invention is a method for sensing and reporting analyte levels in a workspace. The method includes the steps of (i) placing a distal end of a tube attached to an analyte sensor within a workspace, (ii) activating a fan in sealed fluid communication with the lumen of the tube so as to continuously move gaseous content from the workspace through the tube and into operative engagement with the sensor, and (iii) sensing and reporting analyte levels in the workspace with the sensor.

A specific embodiment of the second aspect of the invention is a method for controlling inert gas flushing of a form, fill, and seal machine workspace. The method includes the steps of (i) placing the distal end of a tube attached to an oxygen sensor within the workspace of a form, fill, and seal machine, (ii) activating a fan in sealed fluid communication with the lumen of the tube so as to continuously move gaseous content from the workspace through the tube and into operative engagement with the oxygen sensor, (iii) sensing and reporting $O_2$ levels in the workspace with the oxygen sensor, and (iv) adjusting a flow rate of inert gas into the workspace based upon the reported level of $O_2$ in the workspace.

DETAILED DESCRIPTION OF A PREFERRED EMBODIMENT

Nomenclature

10 Gas Analyte Sensing System
20 Analyte Sensor
30 Fan
31 Housing
32 Rotar
33 Blades
40 Tube
49 Lumen of Tube
50 Workspace
60 Gas Introduction System
61 Introduced Gas
70 Flow Control Valve
100 Microcontroller

DEFINITIONS

As utilized herein, including the claims, the term "fan" means a machine including at least a rotor, blades and a housing for moving gases at relatively low pressure differentials wherein the blades do NOT sealingly engage the housing.

Description

Construction

The gas analyte system 10 of the present invention is effective for measuring the concentration of a gaseous analyte in a workspace 50. Common analytes of interest include specifically, but not exclusively, carbon dioxide, carbon monoxide, oxygen, ozone, water vapor, and volatile organ compounds such as propane, benzene, toluene, methanol, etc.

Figure 1:
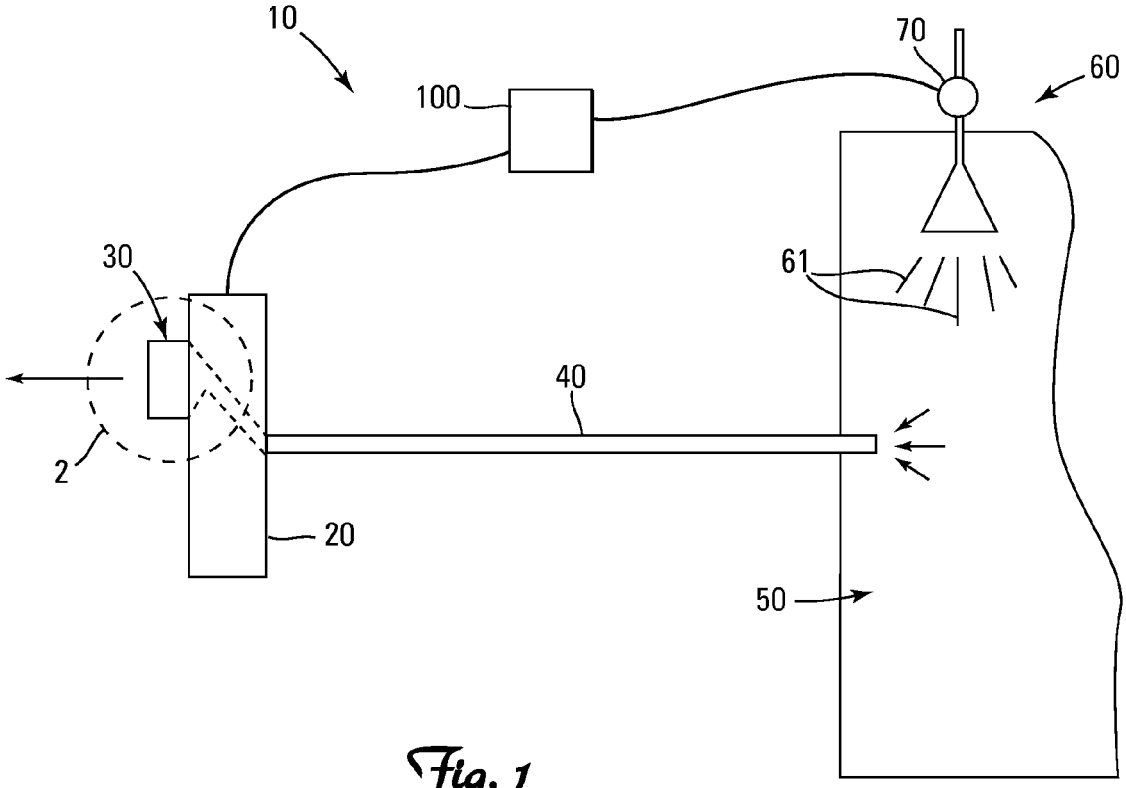
FIG. 1 is a side view of one embodiment of the invention.
Figure 2:
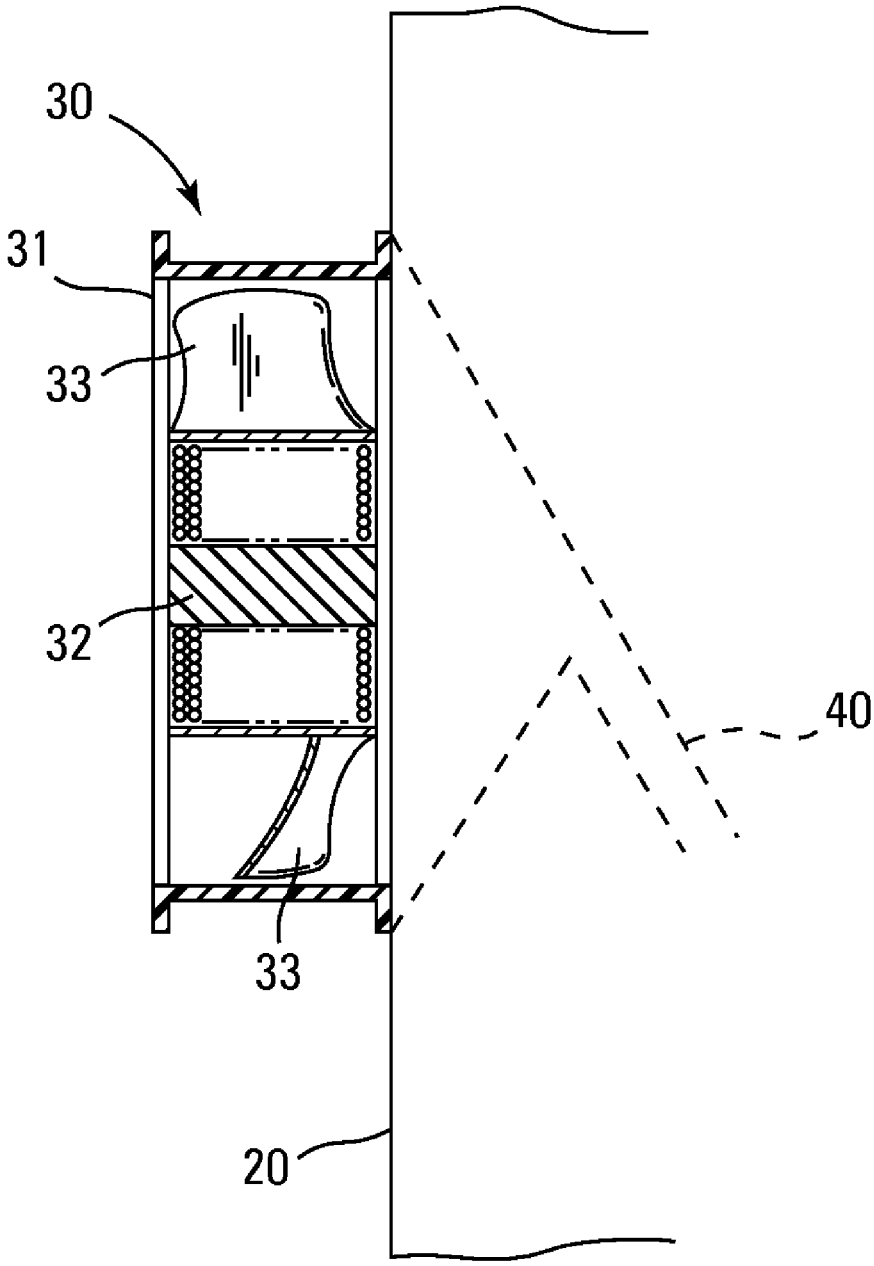
FIG. 2 is a cross-sectional side view of the fan portion of the invention shown in FIG. 1.
Figure 3:
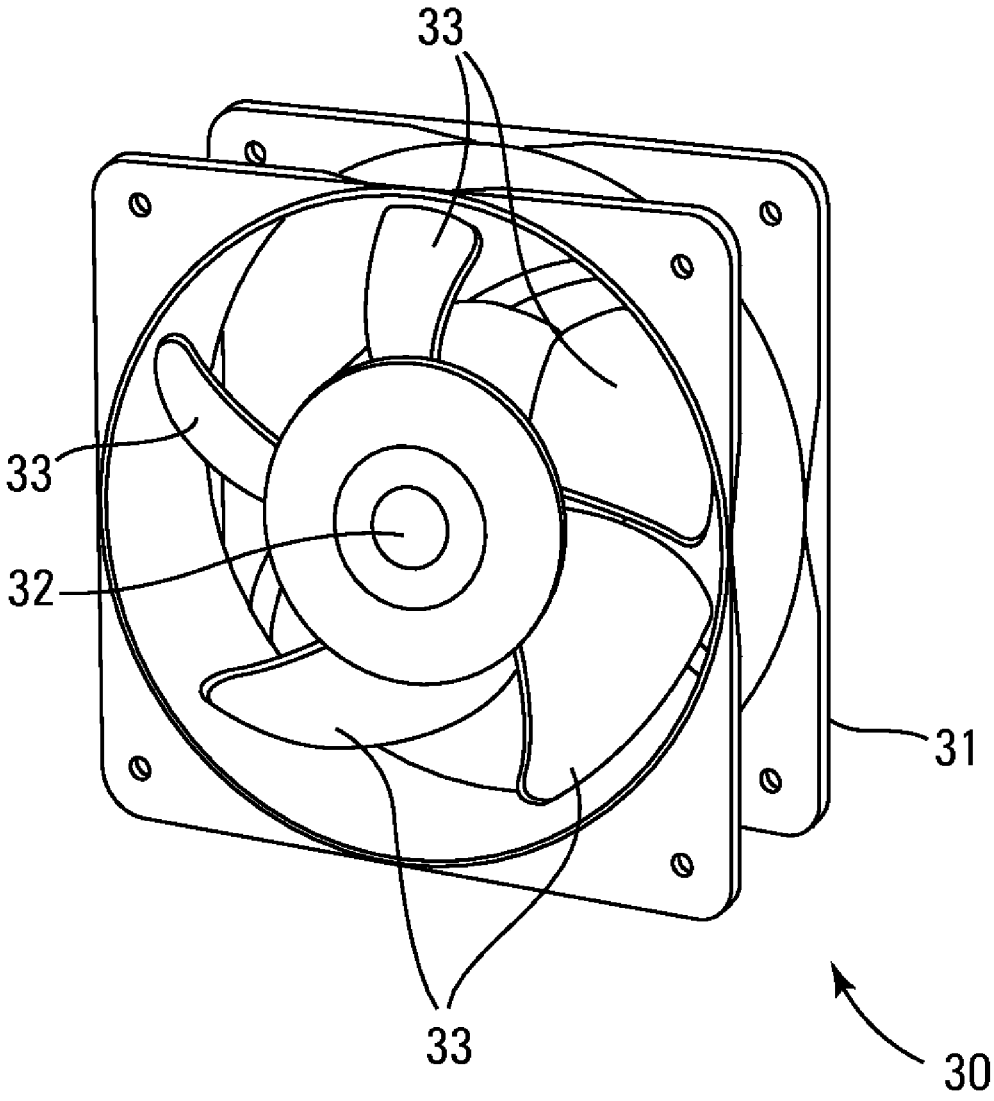
FIG. 3 is a perspective view of the fan portion of the invention shown in FIG. 2.

Referring to FIG. 1, the gas analyte system 10 of the present invention is depicted in fluid communication with a generic workspace 50. The workspace 50 may be defined by any of a number of different pieces of equipment including horizontal and vertical fill and packaging machines. One such piece of equipment is a standard form, fill, and seal machine (not shown) where packaging film (not shown) is fed from a master roll (not shown) into the workspace 50 where the film is formed into individual bags (not shown). The fill unit (not shown) and seal unit (not shown) of the form, fill, and seal machine are located within the workspace 50. The product to be packaged (not shown) (e.g., potato chips) is stored within a hopper (not shown) and directed by feeder tubes (not shown) into bags after the bags have been formed. The filled bags are moved through the workspace 50 by a first conveyor (not shown) and, upon exiting the workspace 50, are moved away from the workspace 50 for further handling by a second conveyor (not shown).

An inert gas 61, typically $N_2$, $CO_2$ or a combination thereof, is pumped into the workspace 50 through a gas introduction system 60 for purposes of reducing $O_2$ levels in the workspace 50. By way of example, snack food such as potato chips are typically packaged with an $O_2$ concentration of less than about 3% in the headspace (not shown) of the bag. By reducing $O_2$ levels in the workspace 50, the $O_2$ levels in the headspace of the sealed bags formed by the form, fill, and seal machine will contain reduced $O_2$ levels corresponding to the $O_2$ concentration within the workspace 50 as the headspace is filled with air from the workspace 50.

Referring to FIG. 1, an analyte sensor 20 effective for sensing the concentration of an analyte of interest is placed in fluid communication with the workspace 50 via suitable tubing 40. The sensor 20 can be provided with a display (not shown) for reporting sensed analyte levels to an operator and/or placed in electrical communication with a microcontroller 100 for reporting sensed analyte levels to the microcontroller 100.

The gas introduction system 60 is equipped with a flow-control valve 70 for allowing manual or automatic control of gas flow through the gas introduction system 60 based upon the sensed and reported concentration of analyte within the workspace 50. The gas introduction system 60 can be used to introduce an inert gas within the workspace 50 in order to maintain a reduced concentration of an analyte within the workspace 50 (i.e., a flushing system), or alternatively can be used to introduce a reactive gas within the workspace 50 in order to maintain a desired reactive environment within the workspace 50 (i.e., reactant supply system). An exemplary use of the gas introduction system 60 as a flushing system places the flow-control valve 70 and the analyte sensor 20 into electrical communication with a microcontroller 100 programmed to open valve 70 in order to increase the flow of inert gas into the workspace 50 when the analyte sensor 20 senses an analyte level above a defined upper threshold value (e.g., 4%) to prevent contamination of product processed within the workspace 50, and close valve 70 in order to decrease the flow of inert gas into the workspace 50 when the analyte sensor 20 senses an analyte level below a defined lower threshold value (e.g., 2%) to prevent overuse of inert gas.

An exemplary use of the gas introduction system 60 as a reactant supply system places the flow-control valve 70 and the analyte sensor 20 into electrical communication with a microcontroller 100 programmed to open valve 70 in order to increase the flow of analyte into the workspace 50 when the analyte sensor 20 senses an analyte level below a defined lower threshold value (e.g., 40%) to ensure the presence of sufficient analyte within the workspace 50, and close valve 70 in order to decrease the flow of the gaseous analyte into the workspace 50 when the analyte sensor 20 senses an analyte level above a defined upper threshold value (e.g., 50%) to prevent overuse of analyte.

Gas samples for testing by the analyte sensor 20 are withdrawn from the workspace 50 through tubing 40 on a continuous basis by a fan 30 in sealed fluid communication with the lumen 49 of the tube 40. The fan 30 includes a housing 31, rotor 32 and blades 33 for continuously pulling gases at relatively low pressure differentials through the tube 40. I have surprisingly discovered that suitable samples may be pulled from a workspace 50 and passed by an analyte sensor 20 utilizing a fan 30 (i.e., a machine for moving gases at relatively low pressure differentials wherein the blades do not sealingly engage the housing) rather than a pump (i.e., a machine for moving fluids at relatively high pressure differentials wherein the blades sealingly engage the housing), resulting in a significant cost savings and substantial increase in the useful life of the gas analyte sensing system 10.

A wide range of fans 30 may suitably be used in the gas analyte sensing system 10. Preferred fans 30 are the small fans (i.e., typically about 1-10 inches wide by about 1-10 inches tall and about ½-2 inches thick) with an RPM of between about 1,500 and about 15,000 widely used on CPUs and in similar applications.

The sensing system 10 should be constructed, configured and arranged to provide a gas flow rate from the workspace 50 through the sensor 20 of at least 0.1 liters/minute as a flow rate of less than 0.1 liters/minute can significantly delay detection of a change in analyte concentration within the workspace 50. For most applications, the flow rate should be kept below about 5 liters/minute, preferably well below 5 liters/minute as a flow rate of greater than about 5 liters/minute depletes the concentration of desired gases from the workspace 50 without a corresponding benefit. The primary variables affecting flow rate are the performance rating of the fan 30 employed and the size of the lumen 49 in the tube 40.

Use

The gas analyte system 10 may be effectively deployed and used to sense and report analyte levels in a workspace 50 by simply (i) placing the distal end **40*b* of the tube 40 into fluid communication with the workspace 50, (ii) activating the fan 30 so as to continuously move gaseous content from the workspace 50 through the tube 40 and into operative engagement with the sensor 20, and (iii) sensing and reporting analyte levels in the gaseous samples pulled from the workspace 50 with the sensor 20**.

I claim:

1. A system, comprising:

(a) a gas analyte sensor remotely located relative to a workspace, (b) a tube attached to the sensor and defining a lumen through which the sensor is placed in fluid communication with the workspace, and (c) a fan in fluid communication with the lumen of the tube for continuously moving gaseous content from the workspace through the lumen and into operative engagement with the sensor, (d) whereby the sensor can sense and report analyte levels in the workspace.

2. The system of claim 1 wherein the fan is in sealed fluid communication with the lumen of the tube.

3. The system of claim 1 wherein the gas analyte sensor is an oxygen sensor.

4. A system, comprising:

(a) a form, fill, and seal machine defining a workspace open to the atmosphere wherein packaging is filled with a product and sealed, (b) a flush system for flushing the workspace with an inert gas to reduce oxygen levels in the workspace, (c) an oxygen sensor remotely located relative to the workspace, (d) a tube attached to the oxygen sensor and defining a lumen through which the oxygen sensor is placed in fluid communication with the workspace, and (e) a fan in sealed fluid communication with the lumen of the tube for continuously moving gaseous content from the workspace into operative engagement with the oxygen sensor, (f) whereby the oxygen sensor can sense and report $O_2$ levels in the workspace.

5. The system of claim 4 wherein (i) the flush system includes a flow-control valve for controlling flow rate of inert gas through the flush system and into the workspace, and (ii) the system further includes a microcontroller in electrical communication with the flow-control valve and the oxygen sensor for (A) opening the flow-control valve to increase the flow rate of inert gas through the flush system and into the workspace when the oxygen sensor senses an $O_2$ level within the workspace above a defined first threshold value, and (B) closing the flow-control valve to decrease the flow rate of inert gas through the flush system and into the workspace when the oxygen sensor senses an $O_2$ level below a defined second threshold value.

6. The tool of claim 4 wherein the inert gas is $N_2$, $CO_2$ or a combination thereof.

7. The tool of claim 5 wherein the inert gas is $N_2$, $CO_2$ or a combination thereof.

8. A method of sensing and reporting analyte levels in a workspace, comprising:

(a) placing a distal end of a tube attached to an analyte sensor within a workspace, (b) activating a fan in sealed fluid communication with the lumen of the tube so as to continuously move gaseous content from the workspace through the tube and into operative engagement with the sensor, and (c) sensing and reporting analyte levels in the workspace with the sensor.

9. The method of claim 8 further comprising the step of adjusting a flow rate of inert gas into the workspace based upon the reported level of analyte in the workspace.

10. The method of claim 8 wherein the workspace is a workspace defined by a form, fill, and seal machine wherein packaging is filled with a product and sealed.

11. The method of claim 8 further wherein the analyte sensor is an oxygen sensor.

12. A method of controlling inert gas flushing of a form, fill, and seal machine workspace, comprising:

(a) placing the distal end of a tube attached to an oxygen sensor within the workspace of a form, fill, and seal machine, (b) activating a fan in sealed fluid communication with the lumen of the tube so as to continuously move gaseous content from the workspace through the tube and into operative engagement with the oxygen sensor, (c) sensing and reporting $O_2$ levels in the workspace with the oxygen sensor, and (d) adjusting a flow rate of inert gas into the workspace based upon the reported level of $O_2$ in the workspace.

13. The method of claim 12 wherein the flow rate of inert gas into the workspace is automatically increased when the oxygen sensor senses an $O_2$ level within the workspace above a defined first threshold value, and the flow rate of inert gas into the workspace is automatically decreased when the oxygen sensor senses an $O_2$ level within the workspace below a defined second threshold value.

14. The method of claim 12 wherein the inert gas is $N_2$, $CO_2$ or a combination thereof.

15. The method of claim 13 wherein the inert gas is $N_2$, $CO_2$ or a combination thereof.

* * * * *